US006877404B2

(12) United States Patent
Chen

(10) Patent No.: US 6,877,404 B2
(45) Date of Patent: Apr. 12, 2005

(54) MULTI-JOINT WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 0 days.

(21) Appl. No.: 10/617,522

(22) Filed: Jul. 11, 2003

(65) Prior Publication Data

US 2004/0261586 A1 Dec. 30, 2004

(30) Foreign Application Priority Data

Jun. 25, 2003 (TW) ..... 92117206 A

(51) Int. Cl.[7] ..... B25B 23/16

(52) U.S. Cl. ..... 81/177.7; 81/177.9

(58) Field of Search ..... 81/177.7, 177.8, 81/177.9, 177.2; 403/324, 84, 93, 96

(56) References Cited

U.S. PATENT DOCUMENTS

| | | | | |
|---|---|---|---|---|
| 1,205,149 | A * | 11/1916 | Bovee | 81/177.9 |
| 6,131,490 | A * | 10/2000 | Lee | 81/63.1 |
| 6,286,396 | B1 * | 9/2001 | Johnson | 81/60 |
| 6,412,373 | B1 * | 7/2002 | Hsiao | 81/177.7 |
| 6,412,374 | B1 * | 7/2002 | Hsieh | 81/177.7 |

* cited by examiner

*Primary Examiner*—Debra S. Meislin
(74) *Attorney, Agent, or Firm*—Alan D. Kamrath; Nikolai & Mersereau, P.A.

(57) ABSTRACT

A wrench includes a head, a first handle, a second handle and a retaining device. The first includes first and second end. The first end of the first handle is pivotally connected with the head about a first axis. The second handle is pivotally connected with the second end of the first handle about a second axis. The retaining device can retain the first handle in position relative to the head, and the second handle in position relative to the first handle.

23 Claims, 5 Drawing Sheets

MULTI-JOINT WRENCH

FIELD OF INVENTION

The present invention relates to a multi-joint wrench.

BACKGROUND OF INVENTION

Taiwanese Patent Publication No. 135392 discloses a wrench including a head 10 and a handle 20. The head 10 includes an ear 11. The handle 20 includes two ears 21 between which the ear 11 is put. A bolt 24 is driven into a hole 23 defined in one of the ears 21, a hole 131 defined in the ear 11 and a hole 231 defined in the remaining one of the ears 21. Thus, the head 10 is pivotally connected with the handle 20, i.e., this conventional wrench can be bent. This conventional wrench can therefore be used in space that is limited and slightly bent; however, it cannot be operated in limited and crooked space.

The present invention is therefore intended to obviate or at least alleviate the problems encountered in prior art.

SUMMARY OF INVENTION

The primary objective of the present invention is to provide a wrench including a configuration that can adapt to limited and crooked space.

According to the present invention, a wrench includes a head, a first handle, a second handle and a retaining device. The first includes first and second end. The first end of the first handle is pivotally connected with the head about a first axis. The second handle is pivotally connected with the second end of the first handle about a second axis. The retaining device can retain the first handle in position relative to the head, and the second handle in position relative to the first handle.

Other objects, advantages, and novel features of the invention will become more apparent from the following detailed description when taken in conjunction with the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
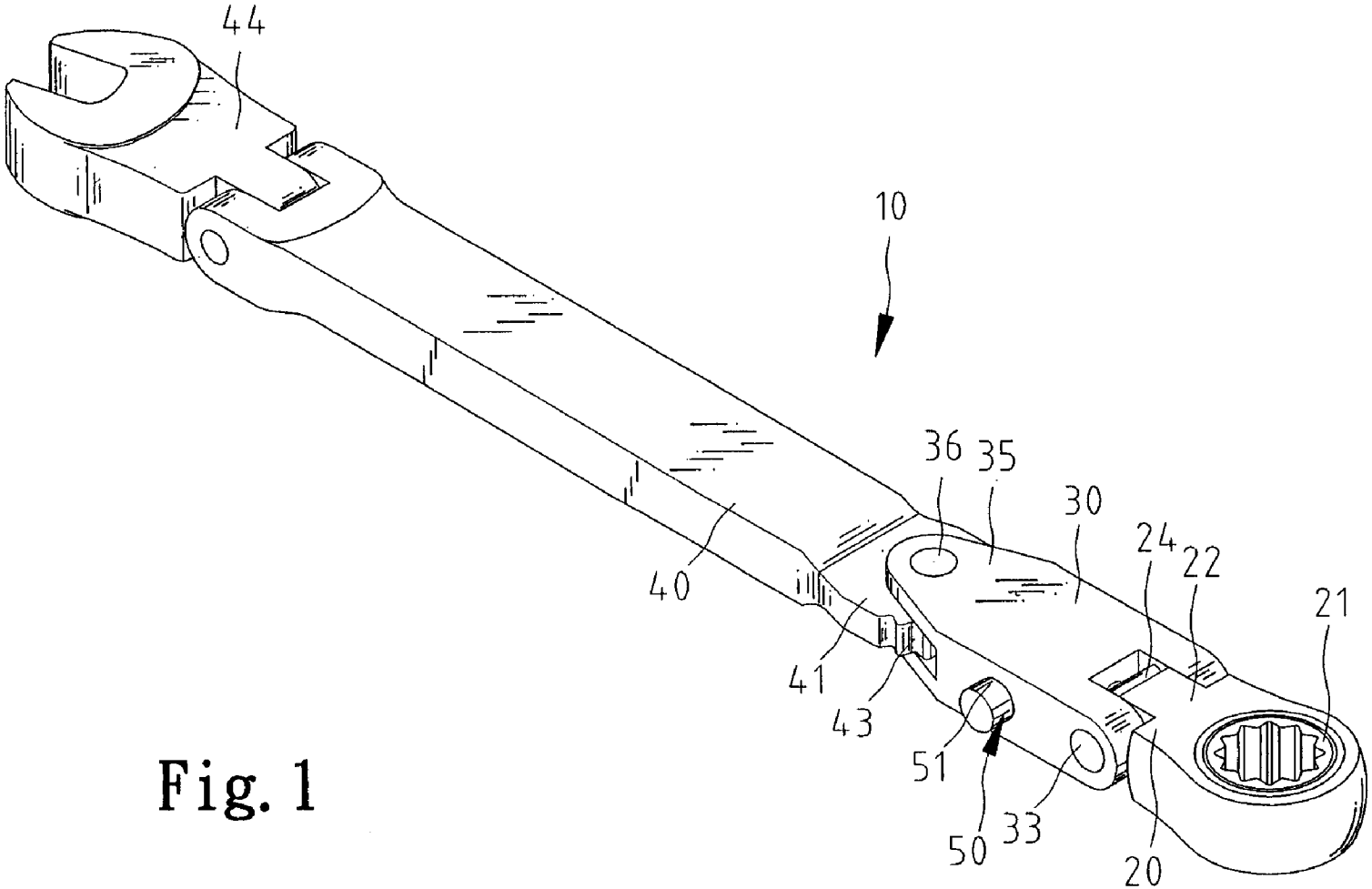
FIG. 1 is a perspective view of a wrench according to the preferred embodiment of the present invention.

Referring to FIG. 1, according to the preferred embodiment of the present invention, a wrench 10 includes a head 20, a first handle 30 pivotally connected with the head 20 about a first axis and a second handle 40 pivotally connected with the first handle 30 about a second axis. The first and second axes are parallel to each other or not. A retaining device 50 can retain the first handle 30 in position relative to the head 20, and the second handle 40 in position relative to the first handle 30.

Figure 2:
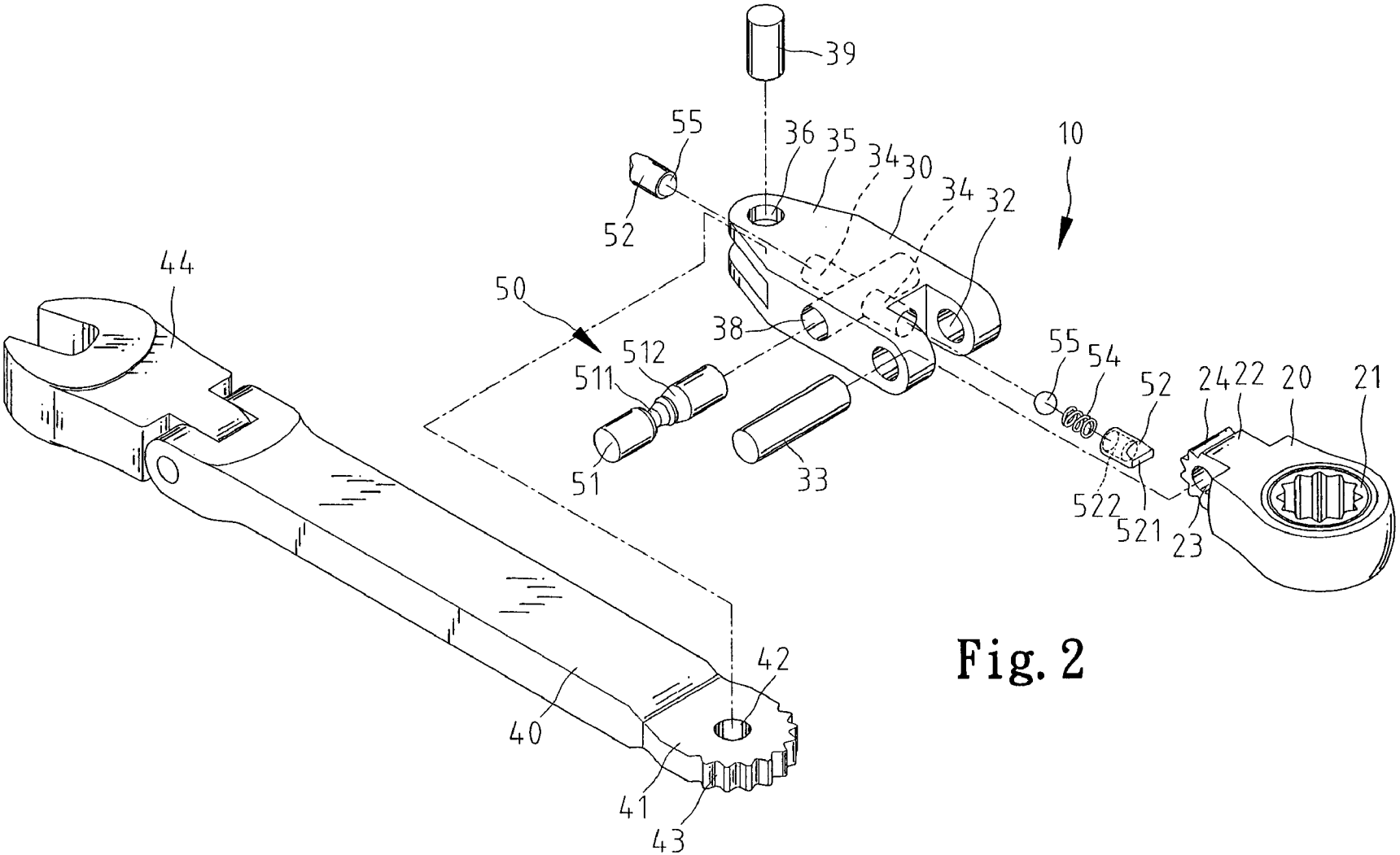
FIG. 2 is an exploded view of the wrench shown in FIG. 1.

Referring to FIG. 2, the head 20 includes an annular portion in which an annular gear 21 is put. A mechanism (not shown) is arranged between the annular portion of the head 20 and the annular gear 21 so that the head 20 can drive the annular gear 21 in selective one of two directions.

The head 20 includes an ear 22 formed thereon. An aperture 23 is defined in the ear 22. The first handle 30 includes two ears 31 formed at a first end. An aperture 32 is defined in each of the ears 31. A pin 33 is fit in the apertures 32 and 23, thus pivotally connecting the first handle 30 with the head 20.

The first handle 30 includes two ears 35 formed at a second end. An aperture 36 is defined in each of the ears 35. The second handle 40 includes an ear 41 formed at a first end. An aperture 42 is defined in the ear 41. A pin 39 is fit in the apertures 36 and 42, thus pivotally connecting the second handle 40 with the first handle 30.

The ear 22 includes a plurality of teeth 24 formed thereon. The ear 41 includes a plurality of teeth 43 formed thereon. The retaining device 50 includes first and second detents 52 movably attached to the first handle 30. The first detent 52 can be engaged with the teeth 24 so as to retain the head 20 in position relative to the first handle 30. The second detent 52 can be engaged with the teeth 43 so as to retain the second handle 40 in position relative to the first handle 30.

The first handle 30 defines first and second detent-receiving holes 34. Each of the detent-receiving holes 34 receives a ball 55, a spring 54 and one of the detents 52. Each of the detents 52 includes a tooth 521 formed at an end for engagement with the teeth 24 or 43 and a recess 522 defined in an opposite end for receiving one of the springs 54.

The first handle 30 defines a switch-receiving hole 38 through which the first detent-receiving hole 34 is communicated with the second detent-receiving hole 34. A switch 51 is put in the switch-receiving hole 38. The switch 51 is in the form of a rod. The switch 51 defines first and second annular grooves 511 and 512 selective one of which receives the balls 55. The first annular groove 511 is deeper than the second annular groove 512.

Figure 3:
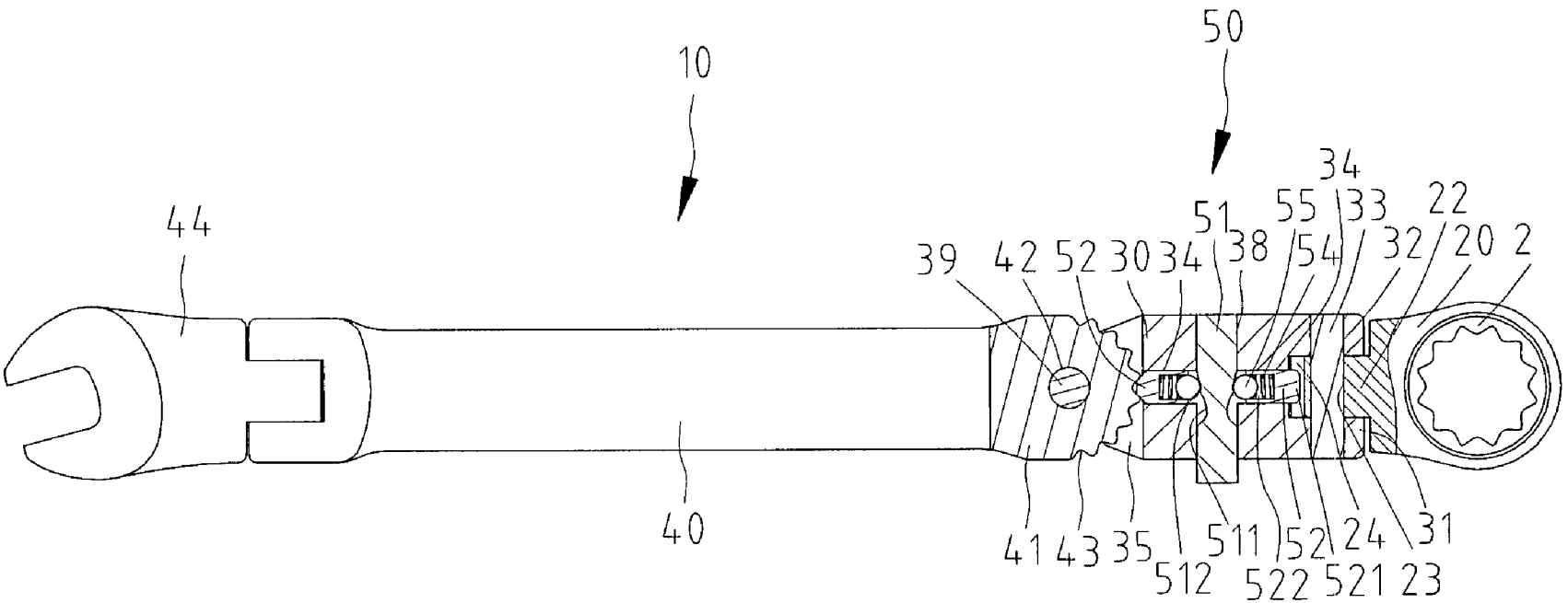
FIG. 3 is a cross-sectional view of the wrench of FIG. 1.

Referring to FIG. 3, the second annular groove 512 receives the balls 55 so that the balls 55 abut the second ends of the detents 52. The tooth 521 of the first detent 52 is firmly engaged with the teeth 24 so as to retain the head 20 in position relative to the first handle 30. The tooth 521 of the second detent 52 is firmly engaged with the teeth 43 so as to retain the second handle 40 in position relative to the first handle 30.

Figure 4:
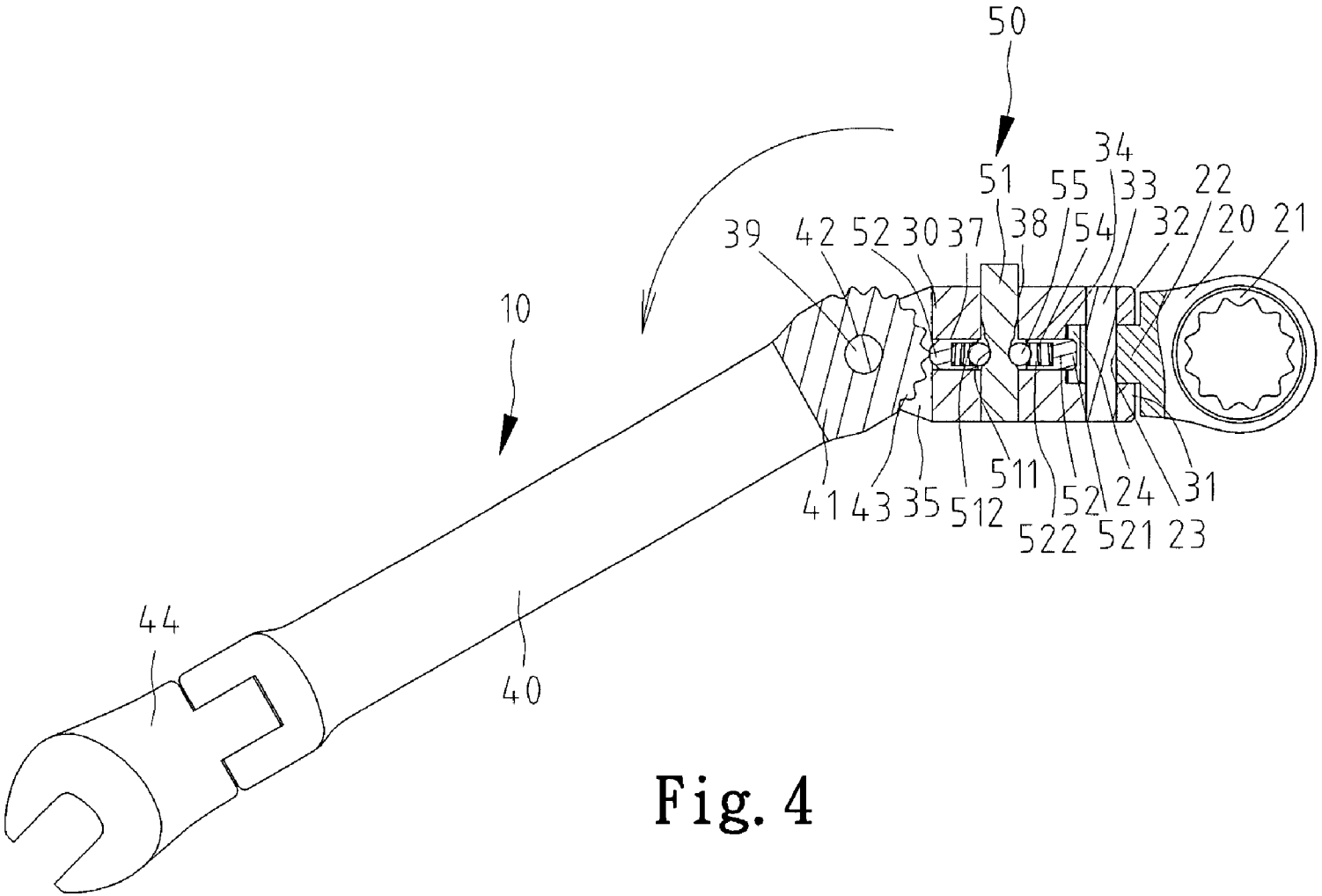
FIG. 4 is similar to FIG. 3 but showing the wrench in another position.

Referring to FIG. 4, the first annular groove 511 receives the balls 55 so that the balls 55 stay away from the second ends of the detents 52. The tooth 521 of the second detent 52 can be disengaged from the teeth 43 so as to allow pivotal of the second handle 40 in position relative to the first handle 30.

Figure 5:
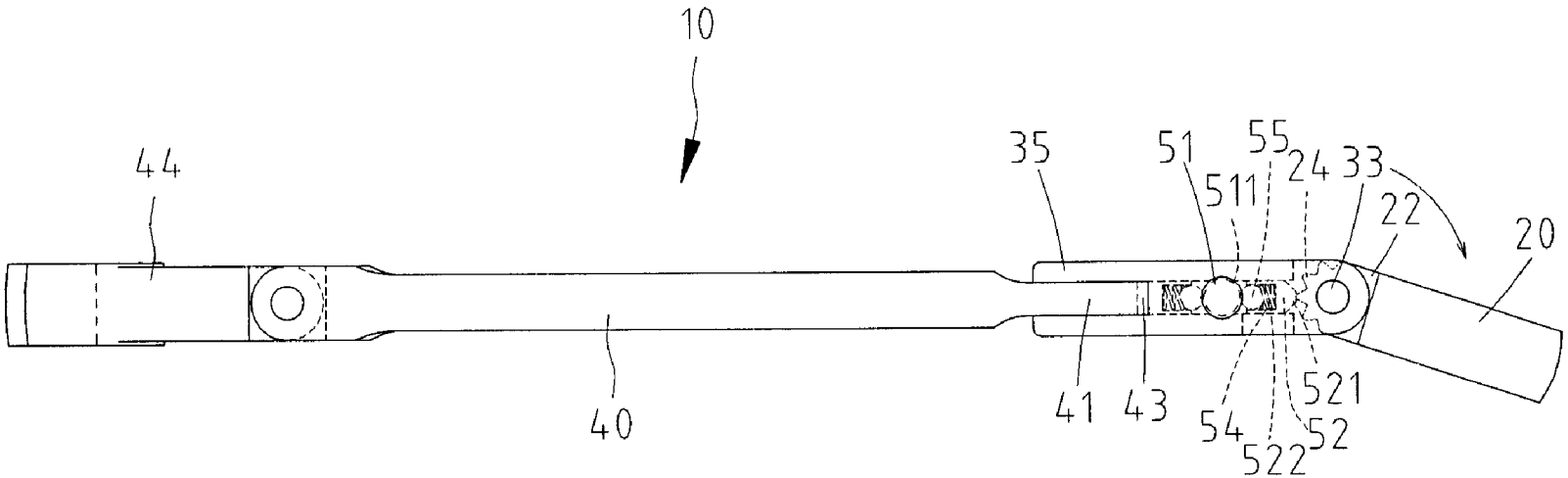
FIG. 5 is a side view of the wrench of FIG. 1.

Referring to FIG. 5, the first annular groove 511 receives the balls 55 so that the balls 55 stay away from the second ends of the detents 52. The tooth 521 of the first detent 52 can be disengaged from the teeth 24 so as to allow pivotal of the head 20 in position relative to the first handle 30.

Another head 44 is pivotally connected with the second handle 40. To this end, the second handle 40 includes two ears (not numbered) at a second end, and the head 44 includes an ear (not numbered) put between the ears formed at the second end of the second handle 40. An aperture (not numbered) is defined in each of the ears formed at the second end of the second handle 40. An aperture (not numbered) is defined in the ear of the head 44. A pin (not numbered) is fit in the apertures defined in the ears formed at the second end of the second handle 40 and the aperture defined in the ear of the head 44, thus pivotally connecting the head 44 with the second handle 40.

The present invention has been described through detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A wrench including:

a head;

a first handle including first and second ends, the first end of the first handle being pivotally connected with the head about a first axis by a first connection;

a second handle pivotally connected with the second end of the first handle about a second axis by a first connection; and a retaining device for retaining the first handle in position relative to the head and the second handle in position relative to the first handle, with the retaining device including a switch mounted on the first handle for movement between a locking position and a releasing position, with relative pivoting of the first and second connections being allowed in the releasing position and with relative pivoting of first and second connections being prevented in the locking position.

2. The wrench according to claim 1 wherein the first and second axes are parallel to each other.

3. The wrench according to claim 1 wherein the first and second axes are not parallel to each other.

4. The wrench according to claim 1 wherein the head includes at least one ear formed thereon, and the first handle includes at least one ear formed at the first end for pivotal connection with the at least one ear of the head.

5. The wrench according to claim 4 wherein the first handle includes two ears formed at the first end, and the head includes only one ear put between the ears formed at the first end of the first handle.

6. The wrench according to claim 4 further including a pin, wherein the at least one ear formed on the head defines an aperture for receiving the pin, and the at least one ear formed at the first end of the first handle defines an aperture for receiving the pin.

7. The wrench according to claim 4 wherein the at least one ear of the head includes a plurality of teeth formed thereon, and the retaining device includes a detent attached to the first handle for engagement with the teeth of the at least one ear of the head so as to retain the head in position relative to the first handle.

8. The wrench according to claim 7 wherein the detent includes a tooth for engagement with the teeth of the at least one ear of the head.

9. The wrench according to claim 7 wherein the first handle defines a detent-receiving hole for receiving the detent.

10. The wrench according to claim 9 further including a ball put in the detent-receiving hole and a spring put in the detent-receiving hole between the ball and the detent.

11. The wrench according to claim 10 wherein the first handle defines a switch-receiving hole communicated with the detent-receiving hole, and the switch defining an annular groove, and the switch is put in the switch-receiving hole between the locking position where the switch pushes the ball against the detent and the releasing position where the annular groove receives the ball so as to allow the ball to leave the detent.

12. The wrench according to claim 11 wherein the switch defines another annular groove for receiving the ball in the locking position.

13. The wrench according to claim 10 wherein the detent defines a recess for receiving the spring.

14. The wrench according to claim 1 wherein the first handle includes at least one ear formed at the second end, and the second handle includes at least one ear formed thereon for pivotal connection with at least one ear formed at the second end the first handle.

15. The wrench according to claim 14 wherein the first handle includes two ears formed at the second end, and the second handle includes only one ear put between the ears formed at the second end of the first handle.

16. The wrench according to claim 14 further including a pin, wherein the at least one ear formed at the second end of the first handle defines an aperture for receiving the pin, and the at least one ear formed on the second handle defines an aperture for receiving the pin.

17. The wrench according to claim 14 wherein the at least one ear of the second handle includes a plurality of teeth formed thereon, and the retaining device includes a detent attached to the first handle for engagement with the teeth of the at least one ear of the second handle so as to retain the second handle in position relative to the first handle.

18. The wrench according to claim 17 wherein the detent includes a tooth for engagement with the teeth of the at least one ear of the second handle.

19. The wrench according to claim 17 wherein the first handle defines a detent-receiving hole for receiving the detent.

20. The wrench according to claim 19 further including a ball put in the detent-receiving hole and a spring put in the detent-receiving hole between the ball and the detent.

21. The wrench according to claim 20 wherein the first handle defines a switch-receiving hole communicated with the detent-receiving hole, and the switch defining an annular groove, and the switch is put in the switch-receiving hole between the locking position where the switch pushes the ball against the detent and the releasing position where the annular groove receives the ball so as to allow the ball to leave the detent.

22. The wrench according to claim 21 wherein the switch defines another annular groove for receiving the ball in the releasing position.

23. The wrench according to claim 1 further including another head pivotally connected with the second handle.

* * * * *